US005606815A

United States Patent [19]

Feldwhere

[11] Patent Number: 5,606,815

[45] Date of Patent: Mar. 4, 1997

[54] POLE-MOUNTABLE POLYGONAL-SECTION SIGN SUPPORT

[75] Inventor: Barry C. Feldwhere, Liss, England

[73] Assignee: Alpha Signs Ltd., Liss, England

[21] Appl. No.: 557,674

[22] Filed: Nov. 13, 1995

Related U.S. Application Data

[63] Continuation of Ser. No. 133,185, filed as PCT/GB92/00764 April 24, 1992, abandoned.

[30] Foreign Application Priority Data

Apr. 25, 1991 [GB] United Kingdom ..... 9108908
Dec. 19, 1991 [GB] United Kingdom ..... 9126977

[51] Int. Cl.[6] ..... G09F 15/00

[52] U.S. Cl. ..... 40/607; 40/610

[58] Field of Search ..... 40/607, 610, 612, 40/606, 539, 310, 311, 331; 248/125, 295.1; 446/48, 80, 85, 95, 109, 112; 116/63 P, 63 C; 229/115, 5.5; 206/485, 446

[56] References Cited

U.S. PATENT DOCUMENTS

| | | | |
|---|---|---|---|
| 2,290,359 | 7/1942 | Ringler | 229/115 X |
| 2,341,374 | 2/1944 | Gardner | 229/5.5 X |
| 2,726,803 | 12/1955 | Ketler | 229/5.5 |
| 3,891,136 | 6/1975 | Woeste | 229/115 |
| 3,947,987 | 4/1976 | Allen . | |
| 4,353,179 | 10/1982 | Jennings | 40/607 X |
| 4,460,119 | 7/1984 | Goodfellow et al. | 40/331 X |
| 4,462,145 | 7/1984 | Schulze . | |
| 4,519,510 | 5/1985 | Learnard . | |
| 4,541,190 | 9/1985 | Weiner et al. | 40/610 |
| 4,862,617 | 9/1989 | Cooke, Jr. et al. | 40/331 X |
| 5,096,073 | 3/1992 | O'Brien | 40/539 X |

FOREIGN PATENT DOCUMENTS

| | | | |
|---|---|---|---|
| 2158821 | 6/1973 | France . | |
| 2939655 | 4/1981 | Germany . | |
| 2227591 | 8/1990 | United Kingdom | 40/310 |
| WO88/08600 | 11/1988 | WIPO . | |

*Primary Examiner*—Joanne Silbermann

[57] ABSTRACT

A sign support comprises a rectangular sheet of a plastic material, which has two fold lines permitting it to be folded to form a closed triangular-section support member. The support member is held closed by the engagement of tongues along one side edge of the sheet engaging in slots in the other side edge, and braced by upper and lower triangular bracing members. The bracing members have tongues along each side, which engage in slots in the upper and lower edges of the folded sheet. The bracing members each have a central aperture and a slot by which they can be mounted on a lamp-post or the like, so that the support member can then be assembled round them. In an alternative construction, the support member comprises three separate sheets which can be connected together by way of tongues and slots in the opposite edges to form the closed triangular section support member.

7 Claims, 4 Drawing Sheets

Fig 10
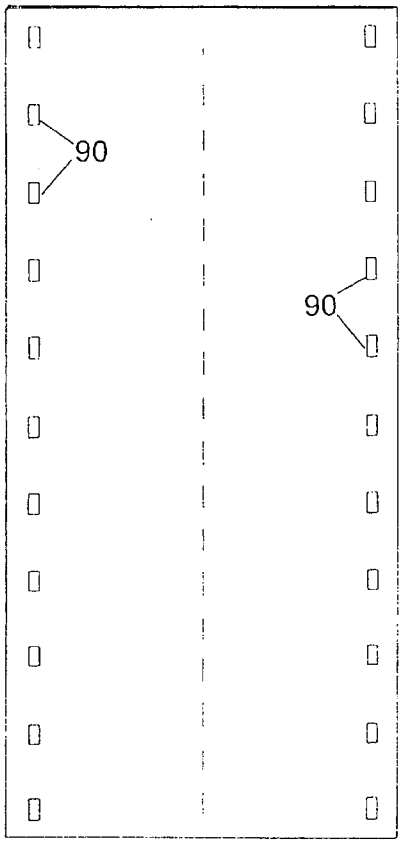
Fig 9
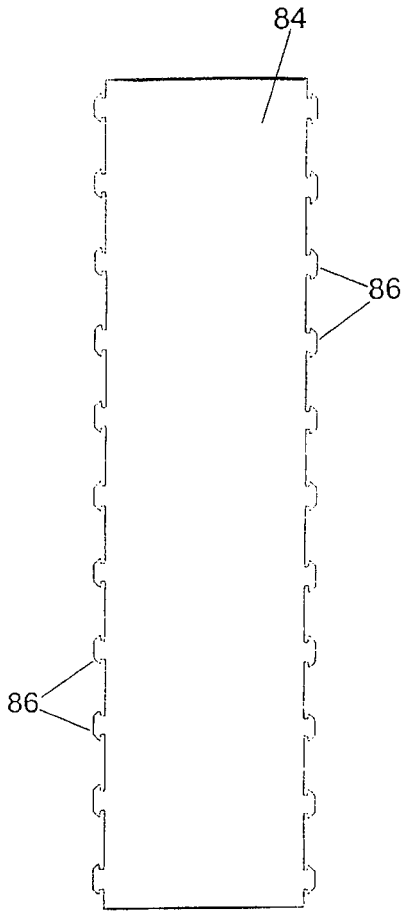
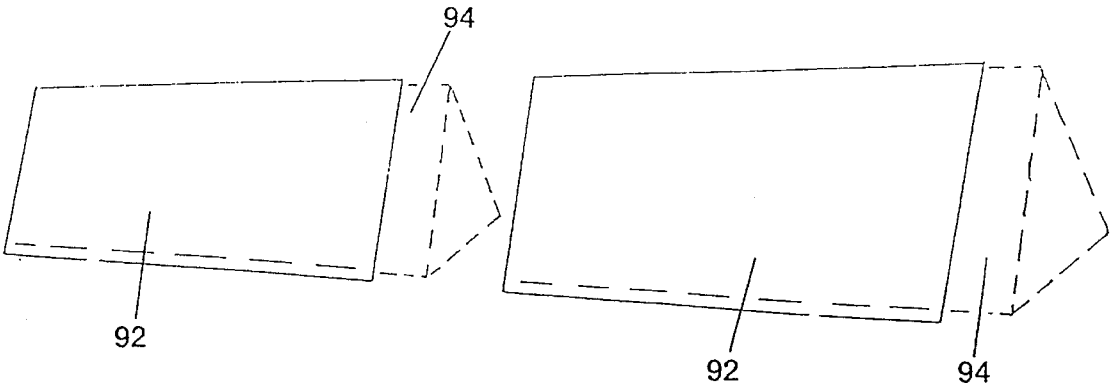
Fig 11

POLE-MOUNTABLE POLYGONAL-SECTION SIGN SUPPORT

This application is a continuation of parent application Ser. No. 08/133,185, filed as PCT/GB92/00764 Apr. 24, 1992 now abandoned.

This invention relates to supports for signs, and to signs incorporating such supports.

Temporary signs for advertising events such as shows or exhibitions, or for providing directions to such events, typically comprise rectangular plates which bear the desired advertisement or directions and which are secured to lamp-posts or like posts in the general vicinity of the event. It is an object of the present invention to provide an improved sign of this general kind.

According to a first aspect of the present invention, a support for a sign comprises a generally rectangular sheet of a flexible support material, which is foldable along a plurality of lines extending substantially parallel to one edge of said sheet to form a closed hollow support member having a plurality of generally rectangular sides, said one edge having at least one slot shaped to receive a cooperating tongue provided on the edge opposite said one edge to hold said support member in its closed state, and one or more of said sides being suitable for supporting a sign, and upper and lower bracing members each being externally shaped to correspond to and fit within the internal sectional shape of said support member in its closed state and having a plurality of tongues adapted to engage in cooperating slots adjacent the other pair of opposite edges of said sheet.

The upper bracing member and/or the lower bracing member can have a central aperture and a slot extending from the aperture to an outer edge of the member, whereby one or both bracing members can be fitted over and can grip a shaft or pole. To this end, the or each aperture is preferably circular with radially-extending slots in its periphery to form radially-inwardly projecting fingers which serve to grip the pole or shaft. Thus in use, the or each bracing member is simply fitted on to a pole such as a lamp-post, the sheet is then folded around it or them, and the various tongues are fitted into the corresponding slots to complete the support. The desired signs, typically advertisements and/or directions for an event such as an exhibition or show, are most conveniently stuck to the rectangular sides of the support prior to the folding step, although this is obviously not essential.

The support can include an electric motor drivingly connected to at least one of the bracing members, eg via the pole, whereby to cause the support to rotate. This arrangement is particularly useful where the support is mounted on a pole which hangs downwardly or projects upwardly from, and forms the output shaft of, the electric motor.

As alternatives to pole mounting, the upper bracing member can have a large central aperture and the lower one can serve to substantially close the lower end of the support, whereby the support can additionally serve as a waste bin or the like, or the upper bracing member can serve to substantially close the upper end of the support, where the support can additionally serve as an occasional table or the like.

Each bracing member is advantageously of the same sheet material as that of the support member.

Said sheet may be made from a suitable waterproofed cardboard material. Alternatively and preferably, it may be made from a plastics material such as polypropylene. The fold lines may be scored, or defined by a line of spaced apart slots or perforations.

The sheet preferably has two fold lines defining three rectangular sides of substantially equal width, whereby the internal sectional shape of the support member is an equilateral triangle. In this case, two such support members can be partly opened up and connected together by way of their tongues and slots to form a closed hollow hexagonal-section member, this form of support being particularly suitable for the additional use as a waste bin or table mentioned earlier.

According to a second aspect of the present invention, there is provided a support for a sign comprising at least three similar generally rectangular sheets of a support material each having at least one slot in one edge and a co-operating tongue in the opposite edge whereby the sheets can be joined together to form a closed hollow support member having a plurality of generally rectangular sides each suitable for supporting a sign, and upper and lower bracing members each externally shaped to correspond to and fit within the internal sectional shape of said support member in its closed state and having a plurality of tongues adapted to engage in cooperating slots adjacent the other pair of opposite edges of each sheet.

This second aspect of the invention is especially suitable for implementing larger sign supports. The bracing members and materials can take any of the forms described earlier in relation to the first aspect of the invention, the previously described additional uses as a waste bin or occasional table are again possible, and rotation by means of an electric motor is also again possible.

According to a third aspect of the invention, there is provided a support for a sign comprising at least three similar generally rectangular sheets of a support material each having a respective flange along its upper and lower edges and along one side edge, the side edge flange having at least one integral connecting means and the other side edge having at least one connecting means adapted to co-operate with the connecting means on the side edge flange, whereby the sheets can be joined together to form a closed hollow support member having a plurality of generally rectangular sides each suitable for supporting a sign, and upper and lower bracing members each shaped to correspond to and fit within the internal sectional shape of the support member.

In this third aspect of the invention, the bracing members can have central apertures as described earlier permitting pole mounting, in which case the bracing members support the support member by way of the flanges on the upper and lower edges of each sheet.

The side flange connecting means and the co-operating connecting means preferably together comprise a plurality of connector studs, advantageously on said other side edge, and a plurality of apertures, advantageously on said side flange, in which the connector studs are a snap fit.

According to a fourth aspect of the invention, there is provided a support for a sign comprising a first generally rectangular sheet of a flexible support material, which is foldable along a line extending substantially parallel to one edge of the sheet, and a second generally rectangular sheet which extends between the respective opposite edges of the first sheet parallel to said line and is connected thereto by way of slots provided adjacent the edges of one sheet and co-operating tongues provided along the edges of the other sheet to form a closed triangular section support structure.

The sign support of the fourth aspect of the invention is typically quite large, eg each side is 1.5 meters by 0.5 meters, and is intended for use with the second sheet extending horizontally and resting on the ground, as a kind of banner.

Conveniently, the slots are in the first sheet and the tongues are on the second sheet.

The first sheet may be foldable in half, and the width of the second sheet may be substantially equal to the width of each half of the first sheet, whereby said triangular-section is substantially equilateral.

Several supports in accordance with the fourth aspect of the invention can be coupled together end to end by means of triangular section joining sleeves which fit inside the open ends of adjacent supports.

The invention also comprises a sign incorporating a support in accordance with any of the first to fourth aspects of the invention.

The invention will now be described, by way of example only, with reference to the accompanying drawings, of which:

FIGS. 9 and 10 show respective parts of a fourth embodiment of a sign support in accordance with the present invention; and FIG. 11 shows an elongate sign support made by connecting together two sign supports in accordance with the fourth embodiment of the invention.

Figure 1:
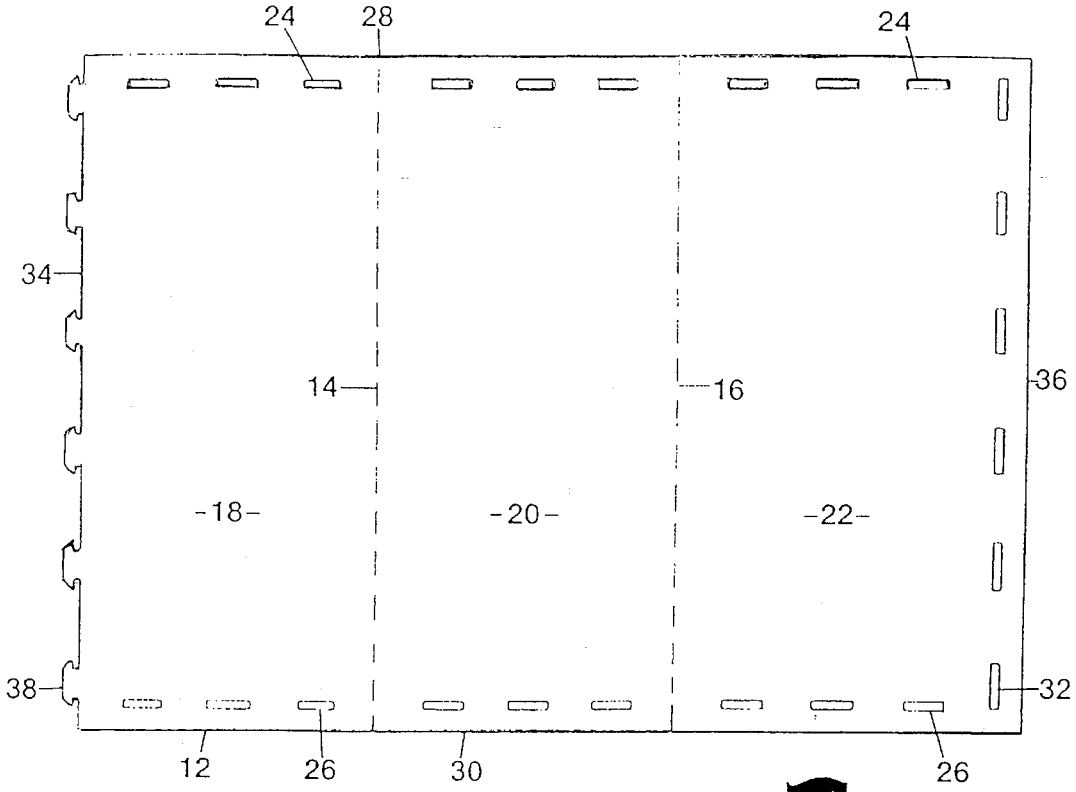
FIG. 1 shows a main sign supporting member of a first embodiment of a sign support in accordance with the present invention.
Figure 2:
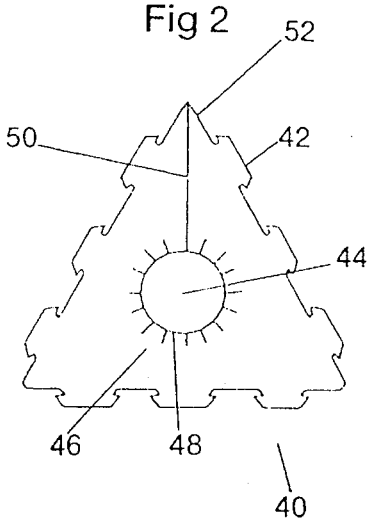
FIG. 2 shows a bracing member forming part of the first embodiment of the present invention.
Figure 3:
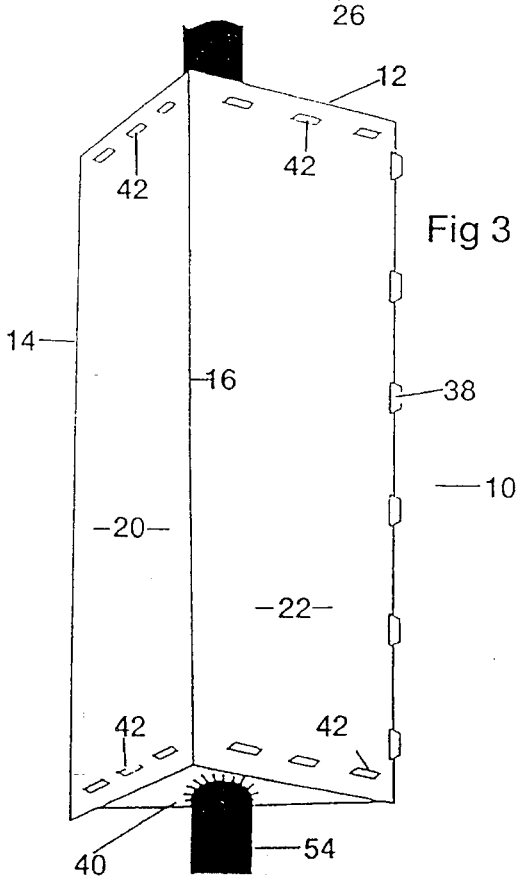
FIG. 3 shows the complete sign support mounted on a lamp-post.

The sign support shown in FIGS. 1 to 3 is indicated generally at 10, and comprises a generally rectangular sheet 12 of a slightly fluted or corrugated plastics material such as polypropylene. Typically, the sheet 12 is about 100 cm wide by 75 cm high by 4 mm thick, and has two scored fold lines 14, 16 which extend parallel to its two shorter edges and divide it into three rectangular portions 18, 20 22 of substantially equal size.

The sheet 12 also has respective rows of slots 24, 26 extending parallel to and adjacent its longer (ie upper and lower) edges 28, 30 respectively, another row of slots 32 extending parallel to and adjacent one edge of its shorter (ie side) edges 34, 36 and a row of tongues 38, shaped and positioned to fit in and engage the slots 32, along the other of its shorter edges 34, 36.

The sign support 10 further comprises two identical flat triangular bracing members 40 each made of the same material as the sheet 12 and each having a row of tongues 42 along each of its three sides. The members 40 each have a circular central aperture 44, whose periphery has radially extending slots 46 which form radially-inwardly projecting resilient FIGS. 48, and a slot 50 extending from the aperture 44 to one apex 52 of the member.

In use, desired signs, such as advertisements for shows or exhibitions and or directions on how to get to them, are printed, stuck or otherwise applied on each of the three portions 18, 20, 22 of the sheet 12. The two bracing members 40 are then mounted one above the other on a lamp-post 54 or similar post or pole by opening their slots 50 to fit them over the post or pole, the fingers 48 serving to grip the post. The sheet 12 is then folded round the post 54 and the bracing members 40, and the tongues 38 are fitted into the slots 34 while the tongues 42 on the upper and lower bracing members 40 are fitted into the slots 24, 26 respectively of the folded sheet 12, thus creating a triangular sign which is securely mounted on the post or pole.

The sign support 10 has the advantages that it is very simple and inexpensive to make, can be easily assembled and disassembled, and is reusable.

Figure 3A:
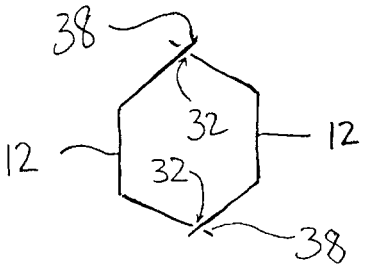
FIG. 3A shows a modification of the sign support of FIGS. 1 to 3.

Several modifications can be made to the sign support 10. For example, it can be made of materials other than plastics materials, eg suitably waterproofed cardboard materials, and it can have sectional shapes other than triangular, eg square or other polygonal shapes, or even circular, the mounting members 40 being correspondingly shaped. Additionally, the present invention also includes a hexagonal-section sign support made by using two similar sheets 12 joined end-to-end by the tongues 34 on one sheet and the slots 32 of the other, the double sheet thus formed then being folded as if it were a single sheet to form a closed hexagonal-section support member (in which case the bracing members 40 are also hexagonal in shape): such a sign support is shown in FIG. 3A.

Figure 4:
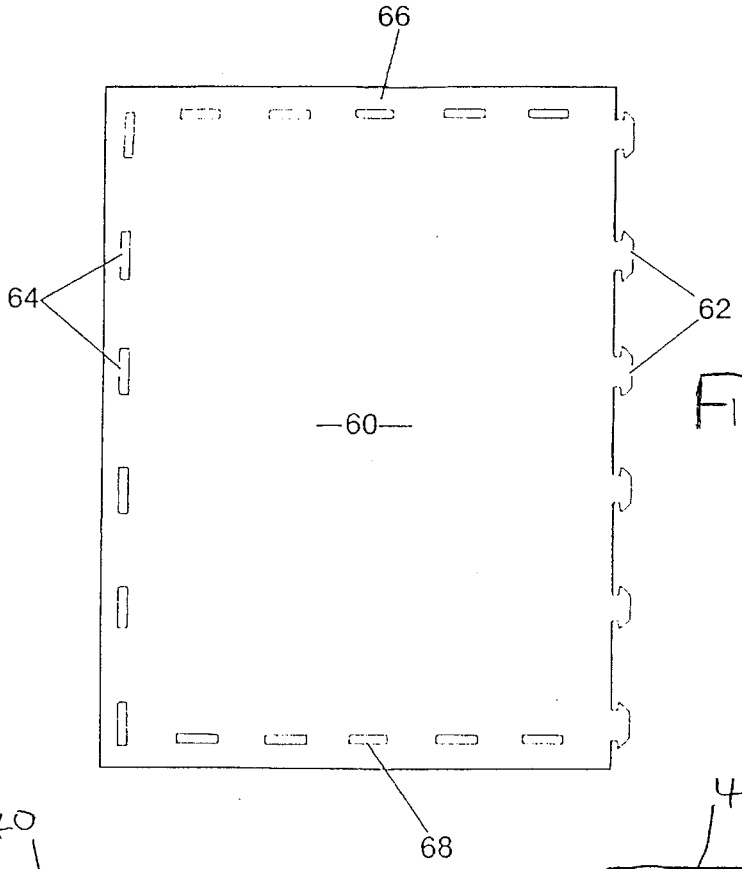
FIG. 4 shows part of a second embodiment of a sign support in accordance with the present invention.

In a second embodiment of a sign support in accordance with the invention, each side of the sign support comprises a single rectangular sheet of the kind shown at 60 in FIG. 4. This second embodiment of the invention is especially suitable for implementing larger sign supports, eg where each side is of the order of 100 cm high by 65 cm wide or greater. Typically, such a larger sign support is triangular, which is achieved by securing together three sheets 60 by inserting tongues 62 projecting from one of the longer sides of each sheet into correspondingly positioned slots 64 provided in the other longer side of the next sheet to form a triangular-section hollow support member similar to that formed by folding the sheet 12, the three sheets being assembled round suitably sized upper and lower bracing members similar to the bracing members 40 by means of slots 66, 68 (equivalent to the slots 24, 26) along their upper and lower edges respectively. The materials used for this embodiment can be as described in relation to the sign support 10.

Sign supports in accordance with the present invention need not be mounted on a pole. Instead they can be rotatably supported, for example by suspending them vertically downwardly from or supporting them vertically above an electric motor, the output shaft of the motor being drivingly coupled to at least the upper or the lower bracing member respectively, either via an aperture similar to the aperture 44 or otherwise.

Figure 4A:
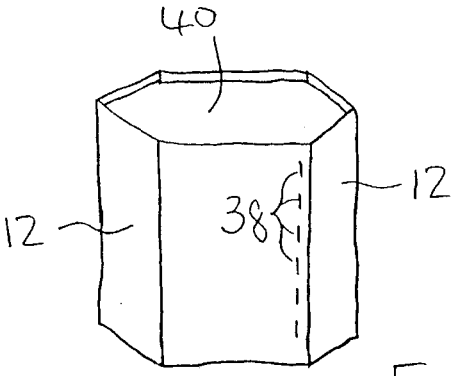
FIGS. 4A and 4B show respective modifications of the sign supports of FIGS. 1 to 4.
Figure 4B:
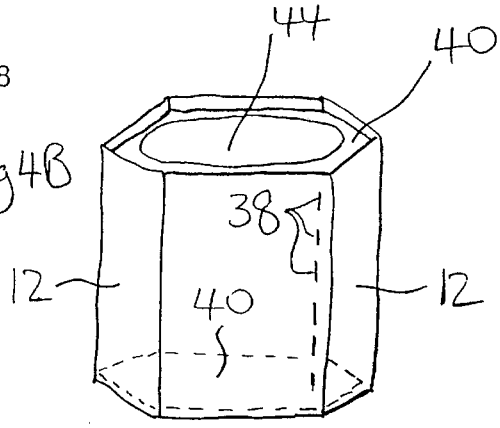
Figure 5:
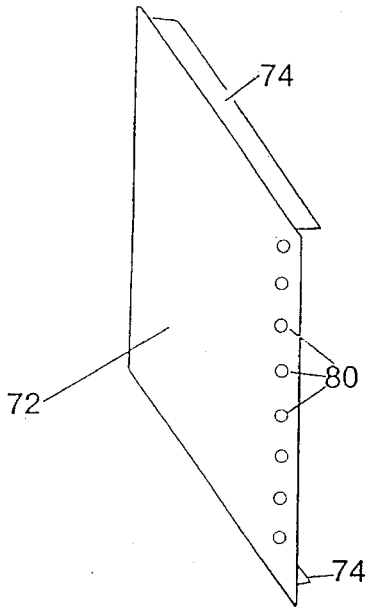
FIGS. 5 and 6 are outside and inside views respectively of part of a third embodiment of a sign support in accordance with the present invention.
Figure 6:
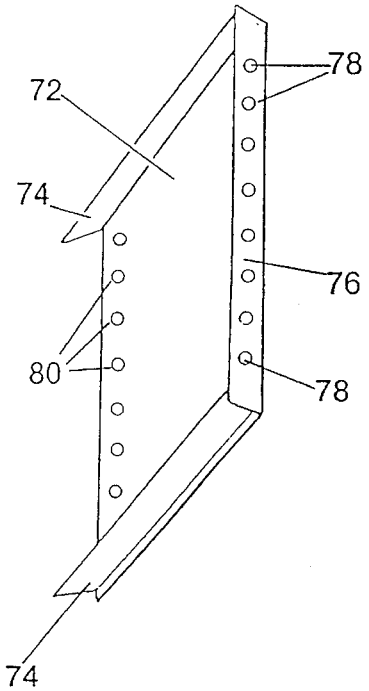
Figure 7:
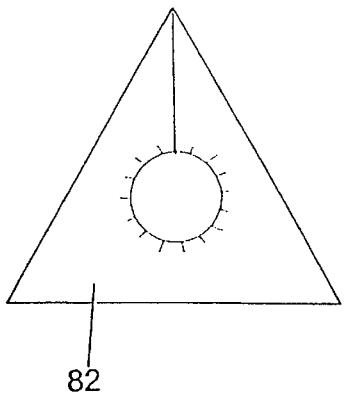
FIG. 7 shows another part of the third embodiment of the invention.
Figure 8:
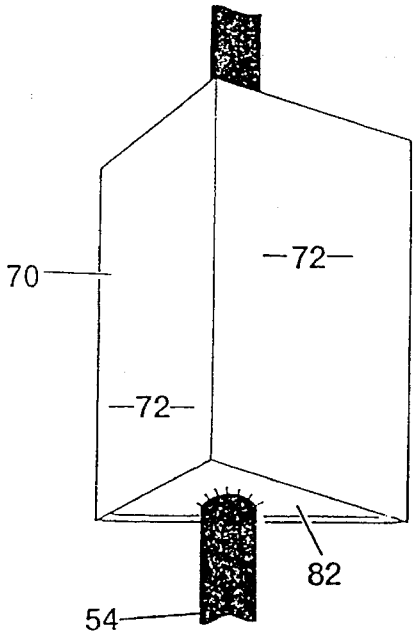
FIG. 8 shows the third embodiment mounted on a lamp-post.

Furthermore, the sign support of the present invention can be adapted to serve additional purposes, ie additional to supporting a sign. For example, by omitting the aperture 44 in the upper bracing member 40, a suitably sized version of the sign support 10, especially the hexagonal-section double-sheet version, can serve as an occasional table, eg for outdoor use at a show or exhibition, while by omitting the aperture 44 in the lower bracing member 40, and enlarging the aperture in the upper bracing member 40, a suitably sized version of the sign support 10, again especially the hexagonal-section double-sheet version, can serve as a litter bin, again typically for outdoor use at a show or exhibition: such a table and such a litter bin are shown in FIGS. 4A and 4B respectively.

A third embodiment of the invention is illustrated in FIGS. 5 to 8. As in the embodiment described with reference to FIG. 4, the sign support 70 of FIGS. 5 to 8 is made up by connecting together three generally rectangular sheets 72 of the kind shown in FIGS. 5 and 6. Each sheet 72 is moulded in a suitable plastics material, eg polypropylene, with integral flanges 74 along (but just slightly spaced from) its upper and lower edges, and another integral flange 76 along one side edge and angled towards the other side edge at about 60°. Additionally, the side flange 76 is provided with a plurality of spaced apertures 78, while the other edge of each sheet 72 is provided with a plurality of correspondingly-spaced complementary connector studs, shown somewhat schematically at 80. The studs 80 are integral with their sheet and dimensioned to be a press fit in the apertures 78 of the adjacent sheet. The sign support 70 is completed by two bracing members 82 of the kind shown in FIG. 7, which are similar to the bracing members 40 (but without the tongues 42).

In use, the sign 70 is assembled by mounting the bracing members 82 on the lamp-post 54 and connecting the sheets 72 together by way of the studs 80 and apertures 78 to form a hollow triangular support structure around the bracing members, this structure being supported by resting the upper and lower flanges 74 on respective ones of the bracing members. The spacing of the lower flange 74 from its edge ensures that the lower bracing member 82 fits just inside the hollow triangular structure formed by the sheets 72.

If desired, the relative dispositions of the apertures 78 and the studs 80 could be reversed, but the resulting sign support is not as neat, since the studs 80 are visible.

A fourth embodiment of a sign support in accordance with the invention is shown in FIGS. 9 to 11, and comprises a generally rectangular base sheet 84 (FIG. 9), typically about 1.5 meters long by 0.5 meters wide, having a plurality of equally spaced integral tongues 86 projecting from both of its longer sides. This fourth embodiment also comprises a second generally rectangular sheet 88 (FIG. 10), about twice the width of the sheet 84, which is foldable into two equal halves along a line parallel to its longer sides, and which has a plurality of slots 90 along each of its longer sides spaced to correspond to the positions of the tongues 86.

To assemble this fourth embodiment, the sheet 88 is folded so that its two halves make an angle of about 60°, and the tongues 86 on the opposite sides of the base sheet 84 are inserted in corresponding ones of the slots 90 in respective ones of the opposed longer sides of the folded sheet 88, to form a triangular-section sign support. This sign support is typically used with the base sheet 84 extending horizontally and the longer edges of the sheet 88 resting on the ground to form a kind of banner, as shown at 92 in FIG. 11. FIG. 11 also shows that two sign supports 92 can be connected together to form an even longer sign support, by means of triangular-section joining sleeves 94 which fit inside the open ends of adjacent sign supports 92. The sleeves 94 can be very slightly smaller forms of the sign supports 92. The materials used in the fourth embodiment of the invention can be as described in relation to the sign support 10 of FIGS. 1 to 3.

I claim:

1. A support for a sign adapted to be mounted to a substantially vertical pole or post without requiring access to an end thereof, the support comprising:

a closed hollow support member having a plurality of generally rectangular sides, one or more of said sides being suitable for supporting a sign, said support member being selected from (a) a generally rectangular sheet of flexible material which is foldable along a plurality of lines extending substantially parallel to one edge of said sheet to form said support member, said one edge being secured to the edge opposite said one edge to hold said support member in its closed state, and (b) at least three similar generally rectangular sheets of a support material each having at least one connecting means in one edge and a co-operating connecting means in the opposite edge whereby the sheets can be joined together to form said support member; and upper and lower bracing members, each externally shaped to correspond to and fit within the internal sectional shape of said support member in its closed state, secured within the upper and lower ends of the support member;

wherein each bracing member has a central circular aperture having radially-extending slots in its periphery to form radially inwardly projecting fingers and a slot extending from the periphery of said aperture to the periphery of the bracing member, whereby, by opening said slot, each bracing member can be fitted around a substantially vertical pole or post without requiring access to an end and wherein said inwardly projecting fingers of each said central aperture engage and grip said pole or post, whereby the support member can then be assembled around, and secured to, the bracing members.

2. A sign support as claimed in claim 1, wherein the sheet has two fold lines defining three rectangular sides of substantially equal width, whereby the internal sectional shape of the support member is an equilateral triangle.

3. A sign support as claimed in claim 1, comprising two such support members each having three sides, said support members being opened up and connected together to form a closed hollow hexagonal-section support member.

4. A sign support as claimed in claim 1, wherein the upper bracing member is modified to have a large central aperature while the lower bracing member is modified to close the lower end of the support, whereby the support can additionally serve as a waste bin.

5. A sign support as claimed in claim 1, wherein the upper bracing member is modified to substantially close the upper end of the support, whereby the support can additionally serve as an occasional table.

6. A sign support as claimed in claim 1, wherein said sheet material is selected from cardboard, water-proofed cardboard and a plastics material such as polypropylene.

7. A sign support as claimed in claim 1, wherein said support member comprises said foldable rectangular sheet and said one edge of said foldable rectangular sheet has at least one slot shaped to receive a co-operating tongue provided on the edge opposite said one edge to hold said support member in its closed state.

* * * * *